US009956438B2

(12) United States Patent
Iversen et al.

(10) Patent No.: US 9,956,438 B2
(45) Date of Patent: May 1, 2018

(54) PUNCH DEVICE

(71) Applicant: ILR Safety CC, Parktown North (ZA)

(72) Inventors: Christen Michael Iversen, Surrey (GB); Ivan De Villiers le Roux, Parktown North (ZA)

(73) Assignee: ILR Safety CC, Parktown North (ZA)

( * ) Notice: Subject to any disclaimer, the term of this patent is extended or adjusted under 35 U.S.C. 154(b) by 0 days. days.

(21) Appl. No.: 15/312,358

(22) PCT Filed: May 13, 2015

(86) PCT No.: PCT/IB2015/053515

§ 371 (c)(1),
(2) Date: Nov. 18, 2016

(87) PCT Pub. No.: WO2015/177686

PCT Pub. Date: Nov. 26, 2015

(65) Prior Publication Data

US 2017/0113074 A1 Apr. 27, 2017
US 2018/0064966 A9 Mar. 8, 2018

(30) Foreign Application Priority Data

May 19, 2014 (ZA) ..... 2014/03667

(51) Int. Cl.
*A62B 3/00* (2006.01)

(52) U.S. Cl.
CPC ..... *A62B 3/005* (2013.01)

(58) Field of Classification Search
CPC ..... A62B 3/005
(Continued)

(56) References Cited

U.S. PATENT DOCUMENTS

D27,459 S 8/1897 Apel
D32,971 S 7/1900 Smith
(Continued)

FOREIGN PATENT DOCUMENTS

DE 10 2005 040 187 A1 3/2007
EP 1 372 787 A1 1/2004
(Continued)

OTHER PUBLICATIONS

PCT/IB2015/053515, dated Nov. 11, 2015, International Search Report and Written Opinion.
(Continued)

*Primary Examiner* — Sean Michalski
(74) *Attorney, Agent, or Firm* — Wolf, Greenfield & Sacks, P.C.

(57) ABSTRACT

The invention concerns a punch device that includes an actuating member of flat proportions, a penetrating tool with a sharp tip carried by the actuating member, a compressible spacer attached to the surface of the actuating member alongside the penetrating tool and mounting means for mounting the punch device on a glass sheet with the tip of the penetrating tool directed towards the glass sheet. The arrangement is such that a force of sufficient magnitude applied to the actuating member in an axial direction towards the glass sheet compresses the spacer and drives the tip of the penetrating tool into contact with the glass sheet thereby to break the glass sheet. In one application the punch device can be used to break an emergency exit window in a bus.

20 Claims, 8 Drawing Sheets

(58) Field of Classification Search
USPC ..... 225/2, 93, 104
See application file for complete search history.

(56) References Cited

U.S. PATENT DOCUMENTS

| | | | | |
|---|---|---|---|---|
| 2,307,281 | A * | 1/1943 | Kraus | B25D 5/00 30/358 |
| D155,426 | S | 10/1949 | Ince | |
| 2,594,901 | A * | 4/1952 | Forster | B25B 27/143 144/195.5 |
| 3,995,821 | A | 12/1976 | Einhorn | |
| 4,268,927 | A * | 5/1981 | Bridwell | B25D 5/00 30/367 |
| 4,592,467 | A * | 6/1986 | Lechner | B25B 27/0035 206/349 |
| D319,862 | S | 9/1991 | Lahger | |
| D344,252 | S | 2/1994 | Choi | |
| D350,178 | S | 8/1994 | Kristovich | |
| D363,901 | S | 11/1995 | Le | |
| D375,460 | S | 11/1996 | Tanaka | |
| 5,584,219 | A * | 12/1996 | Dunn | A62B 3/00 225/103 |
| D385,771 | S | 11/1997 | Chiang | |
| D420,269 | S | 2/2000 | Ben-Moshe | |
| 6,199,997 | B1 | 3/2001 | Outsen et al. | |
| 6,270,165 | B1 | 8/2001 | Peay | |
| D459,190 | S | 6/2002 | Chen | |
| 6,418,628 | B1 * | 7/2002 | Steingass | A62B 3/005 30/366 |
| D465,396 | S | 11/2002 | Song | |
| D472,444 | S | 4/2003 | Gesheit | |
| 6,766,933 | B1 * | 7/2004 | Wang | A62B 3/005 173/202 |
| 6,782,576 | B1 | 8/2004 | Valencic et al. | |
| D498,401 | S | 11/2004 | Lin et al. | |
| D499,003 | S | 11/2004 | Chiang | |
| 6,811,435 | B1 | 11/2004 | Fan | |
| D520,840 | S | 5/2006 | Bhavnani | |
| D577,562 | S | 9/2008 | Lin et al. | |
| D627,021 | S | 11/2010 | Savarese et al. | |
| D647,130 | S | 10/2011 | Kim et al. | |
| D647,230 | S | 10/2011 | Bertken | |
| D676,183 | S | 2/2013 | Lee | |
| D676,184 | S | 2/2013 | Lee | |
| D683,644 | S | 6/2013 | Stowers | |
| D734,118 | S | 7/2015 | Goldy et al. | |
| 2003/0057247 | A1 * | 3/2003 | Farr | B60J 10/45 225/93 |
| 2003/0089755 | A1 * | 5/2003 | Peers-Smith | A62B 3/005 225/103 |
| 2005/0082331 | A1 | 4/2005 | Yang | |
| 2010/0301088 | A1 * | 12/2010 | Purdy | A62B 3/005 225/103 |

FOREIGN PATENT DOCUMENTS

| | | | |
|---|---|---|---|
| GB | 2 265 406 | A | 9/1993 |
| GB | 2 412 687 | A | 10/2005 |
| JP | H11-222087 | A | 8/1999 |
| JP | 2001-354090 | A | 12/2001 |
| KR | 20-0439195 | Y1 | 3/2008 |
| ZA | 91/8034 | | 7/1992 |
| ZA | 2009/03564 | | 5/2009 |
| ZA | F2009/00818 | | 6/2009 |

OTHER PUBLICATIONS

International Search Report and Written Opinion for Application No. PCT/IB2015/053515, dated Nov. 11, 2015.
International Preliminary Report on Patentability for Application No. PCT/IB2015/053515 dated Dec. 1, 2016.
U.S. Appl. No. 29/509,610, filed Nov. 19, 2014, Roux et al.
PCT/IB2015/053515, dated Dec. 1, 2016, International Preliminary Report on Patentability.

* cited by examiner

PUNCH DEVICE

CROSS-REFERENCE TO RELATED APPLICATIONS

This application is a national stage filing under 35 U.S.C. § 371 of International PCT Application No. PCT/IB2015/053515, filed May 13, 2015 and entitled "PUNCH DEVICE," which claims priority to South African Application No. 2014/03667, filed May 19, 2014, the contents of each of which are incorporated herein by reference in their entireties.

BACKGROUND TO THE INVENTION

THIS invention relates to a punch device.

There are many applications in which it is necessary or desirable to have a device capable of reliably breaking a pane or sheet of glass, such as that in a window or glass door. This may for example be for emergency purposes where it necessary to break the glass in order to create an emergency exit.

One common application is in motor vehicles such as buses where a rear window or other window of the vehicle provides an emergency exit from the vehicle. Another common application is in fire alarm installations where a fire alarm is housed in a wall-mounted box covered by a glass window. Yet further common applications are in boats where it may be necessary to break a window in order to gain rapid exit from the vessel.

Traditionally a loose hammer or other heavy impact tool is provided in the vicinity of the glass sheet to enable a person to break the glass sheet by hammering on it. However, hammers or other loose tools can easily be removed, lost or stolen. Apart from this, the type of impact which a relatively blunt tool such as a hammer can apply to a glass sheet is very often insufficient to break certain types of glass, and in particular the toughened glass sheets normally used in motor vehicles. This is primarily because glass sheets of this type have extremely tough external skins which are not easily penetrated.

The specification of South African patent 91/8034 describes devices which can be fitted on a glass pane or sheet, such as a vehicle window, and which can be actuated to break the glass in an emergency situation.

Apart from the fact that these devices have a number of moving parts and fairly complicated constructions, they have the disadvantage that they have fairly large dimensions and hence stand out quite some distance from the window or other glass sheet on which they are fitted. This means that they can present an obstacle to persons close to the window or glass sheet.

The present invention seeks to provide a simpler device of relatively squat proportions.

SUMMARY OF THE INVENTION

According to the invention there is provided a punch device comprising an actuating member of flat proportions, a penetrating tool with a sharp tip carried by the actuating member and projecting transversely from a surface of the actuating member, a compressible spacer attached to the surface of the actuating member alongside the penetrating tool and mounting means for mounting the punch device on a glass sheet with the tip of the penetrating tool directed towards the glass sheet, such that a force of sufficient magnitude applied to the actuating member in an axial direction towards the glass sheet compresses the spacer and drives the tip of the penetrating tool into contact with the glass sheet thereby to break the glass sheet.

The actuating member may comprise a flat disc of rigid material, with the penetrating tool projecting from a major surface of the disc and comprising a body of hard material which has a base at one end and a sharp tip at an opposite end, the base of the body being set into the disc with the tip projecting from the disc.

In such an arrangement, the disc may be made of aluminium and the penetrating tool of tungsten carbide. In an alternative arrangement, the disc and penetrating tool can be formed integrally in one piece, possibly as a ceramic casting or tungsten carbide pressing.

Conveniently the spacer is an annular disc of compressible foam material, such as a closed cell neoprene, surrounding the penetrating tool. This disc may be adhered to the surface of the actuating member.

The mounting means referred to above is conveniently an adhesion means for adhering the punch device to the glass sheet.

The preferred embodiments of punch device further comprise a safety device located operatively in use between the actuating member and the glass sheet when the punch device is adhered to the glass sheet in order to prevent movement of the sharp tip of the penetrating tool into contact with the glass, the safety member being removable to allow such movement. The safety member may comprise a breakable loop located about the compressible spacer. Such loop can include an elongate, flexible element having a first end acting as a pull tab and a second end which passes through an opening in the element in or near the pull tab, the element having a zone of weakness at which it will break if a pulling force of sufficient magnitude is applied to the pull tab.

In another arrangement, the punch device includes a cover member extending about a peripheral edge of the actuating member to prevent access to such edge for the purposes of prising the punch device off a glass sheet to which it is adhered. In this case, the safety device may comprise a strip of flexible material threaded into a gap between the cover member and the compressible spacer.

Conveniently the punch device has an overall thickness, measured in the axial direction, of less than 10 mm, preferably 9 mm or even less.

Another aspect of the invention provides a multi-glazed installation (for example double- or triple-glazed) comprising a first glass sheet, a second glass sheet spaced from the first glass sheet, a first punch device as summarised above mounted on the first glass sheet and a second punch device as summarised above mounted on the second glass sheet in the space between the glass sheets with the penetrating tools of the punch devices being in axial alignment with one another.

BRIEF DESCRIPTION OF THE DRAWINGS

The invention will now be described in more detail, by way of example only, with reference to the accompanying drawings in which.

DESCRIPTION OF THE ILLUSTRATED EMBODIMENTS

The punch device 10 illustrated in FIGS. 1 to 7 includes an actuating member or striker plate in the form of a round disc 12 of flat proportions, i.e. its thickness 14 (see FIG. 6) is considerably less than its transverse dimension, in this case the diameter of the disc.

Figure 6:
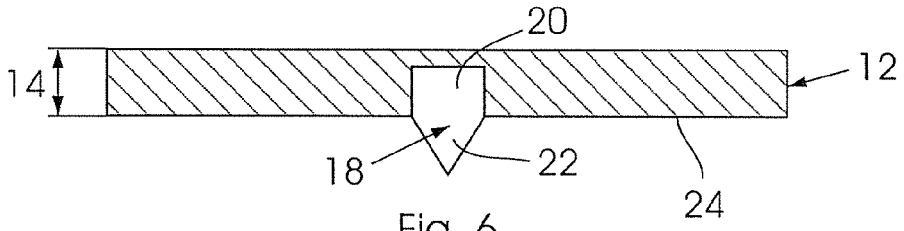
FIG. 6 shows a cross-sectional view of the actuator disc and penetrating tool.

Referring to FIG. 6, the punch device 10 also includes a penetrating tool 18 made of a hard material, in this case tungsten carbide. This tool has a base 20 which is set into and anchored to the disc 12 at a central position and a sharp, generally conical tip 22 which projects from a major surface 24 of the disc. In practice, the base may be set into the disc by a punching operation.

The punch device 10 also includes a compressible spacer provided by an annular disc 26 of foam material, in this case a soft grade of closed cell neoprene, typically that marketed by 3M Company under the designation SCE41B. One major surface 28 of the spacer disc 26 carries adhesive by means of which it is adhered to the surface 24 of the actuator disc 12 so as to surround the penetrating tool 18 concentrically.

In practice, the disc 26 may be cut from material having adhesive on both major surfaces, such adhesive initially being covered by peel off layers 25, 27. During assembly of the device 10, the peel-off layer 25 covering the surface 28 is peeled off to expose the adhesive which is then used to adhere the spacer disc to the surface 24 of the actuator disc 12.

A further component of the punch device 10 is an adhesion means provided by a flat, annular element 30 carrying adhesive on both major surfaces. In this embodiment, the element 30 is of a product marketed by 3M Company under the designation 4936F. The adhesive surfaces of element 30 are initially covered by peel-off layers 29, 31.

Figure 5:
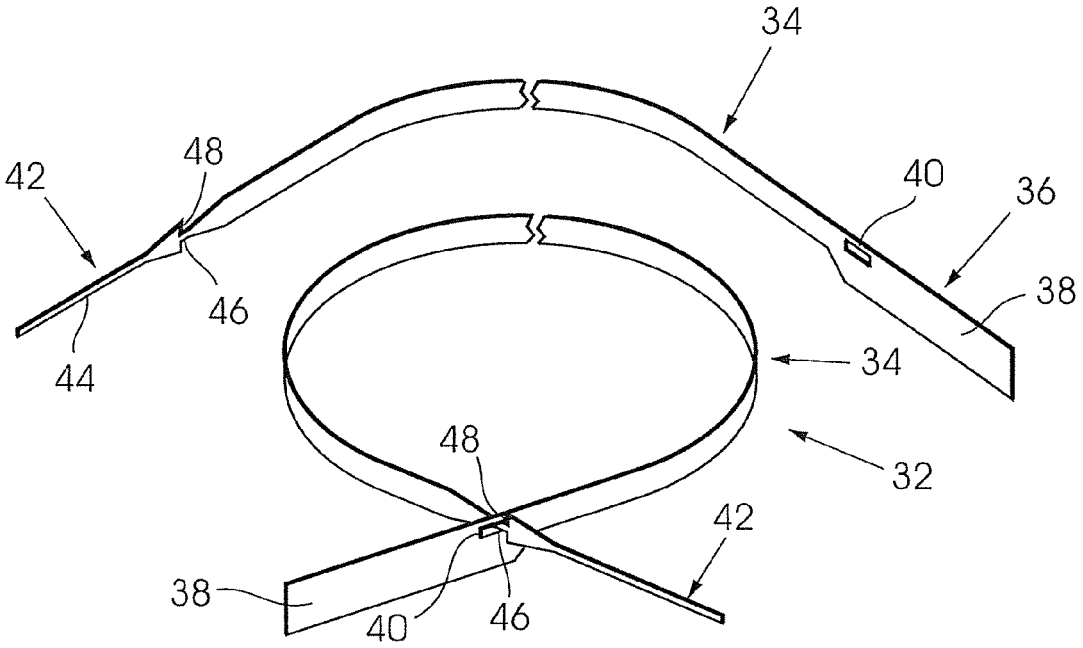
FIG. 5 shows perspective views of a safety device before and after it is formed into a loop.

The punch device 10 also includes a safety device 32. Referring to FIG. 5, the safety device is provided by a flat, elongate strip, in this case a suitable grade of polypropylene. One end 36 of the strip 34 provides a relatively broad pull tab 38 in which a slot-shaped opening 40 is formed. The opposite end 42 of the strip 34 includes a generally arrow-shaped terminal portion 44 which is joined to the remainder of the strip at a slender zone or point of weakness 46.

The safety device is assembled by twisting the end 42 of the strip through 90° so that the terminal portion 44 is aligned with the opening 40, feeding the terminal portion through the opening and then allowing the terminal portion to return, under the natural resilience of the strip material, to an orientation at which it is at right angles to the length of the opening, with the result that the terminal portion cannot then return through the opening.

Figure 1:
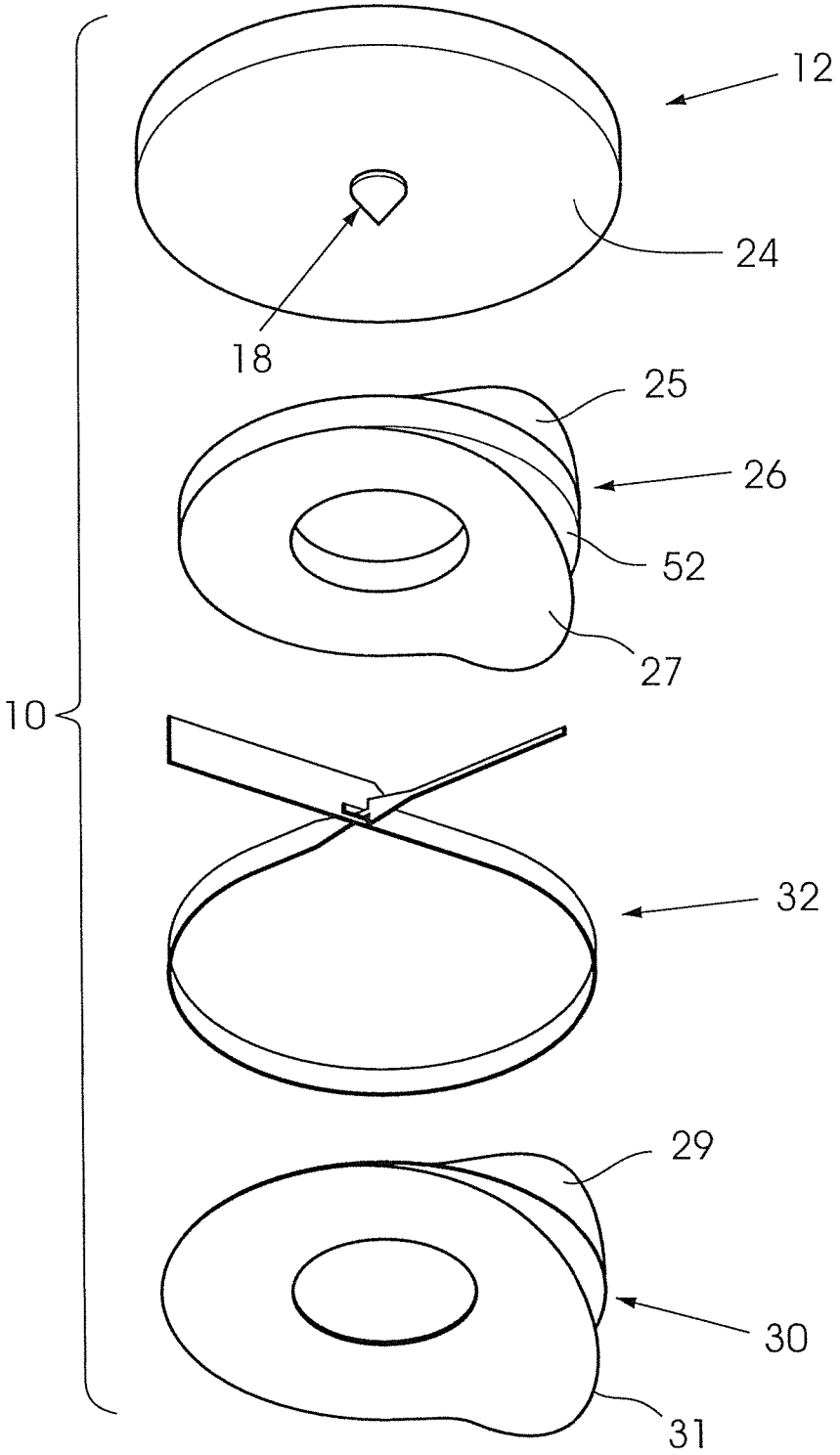
FIG. 1 shows an exploded perspective view of a first embodiment of punch device according to this invention.

At this stage, as seen in FIGS. 1 and 5, a rear edge 48 of the arrow-shaped terminal portion locates against the tab with the zone of weakness 46 located within the opening 40, and the safety device forms a closed loop from which the pull tab and terminal portion project. The transverse dimension of the loop, in which the flat strip 34 is on edge, is greater than the outside diameter of the spacer disc 26.

Figure 2:
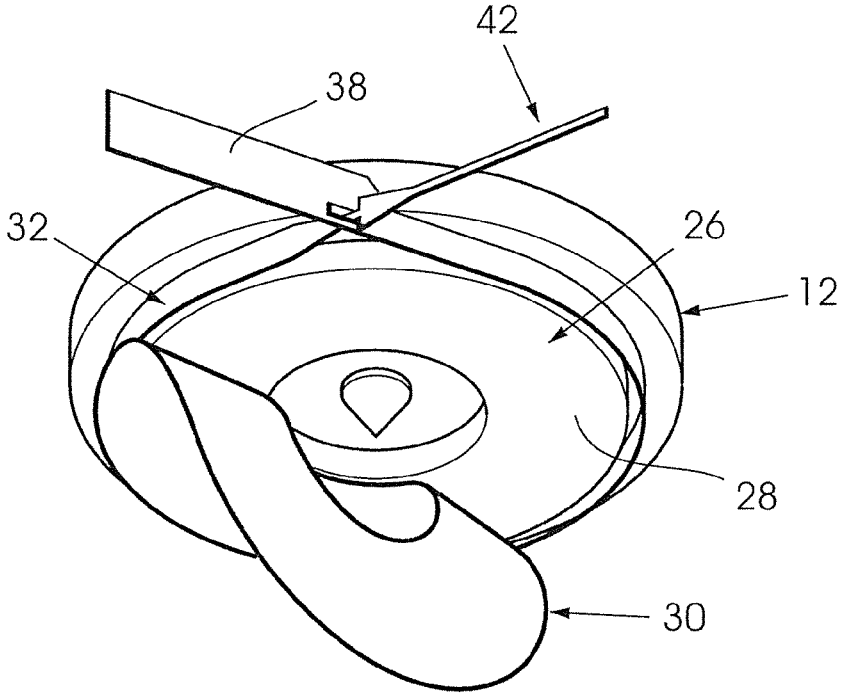
FIG. 2 shows a perspective view of the punch device before installation on a glass sheet.
Figure 3:
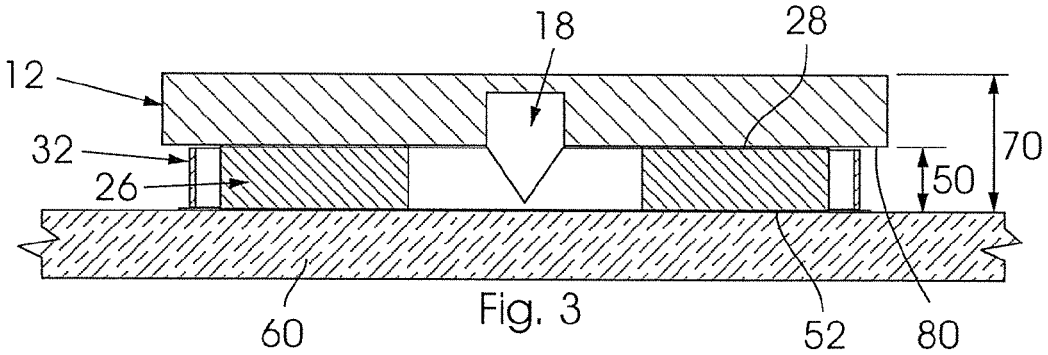
FIG. 3 shows a cross-sectional view of the punch device after installation but before actuation.

During assembly, the loop-shaped device 32 is placed on the surface 24 of the actuator disc 12 so as to surround the spacer disc 26 as seen, for example, in FIGS. 2 and 3. The width 50 of the region of the strip which forms the loop, and which defines the thickness of the device in an axial sense, may be about the same as the thickness of the spacer disc 26.

During assembly, the safety device 32 is attached relative to the actuating disc 12 by the element 30, which has an outer diameter greater than the transverse dimension of the loop. In order to achieve this, the peel-off layer 27 covering the other, exposed major surface 52 of the spacer disc, and the peel-off layer 29 covering one surface of the element 30 are peeled off, whereafter the element 30 is laid over the exposed surface 52 of the spacer disc and also over the exposed edge of the safety device.

The element 30 adheres to both the spacer disc and to the safety device, and accordingly attaches the safety device indirectly to the spacer. It also adheres the safety device indirectly to the actuator disc, thereby holding the punch device 10 together as an assembled unit ready for installation, as shown in FIG. 2. The remaining peel-off layer 31 is left in position covering the other adhesive surface of the element 30.

Figure 7:
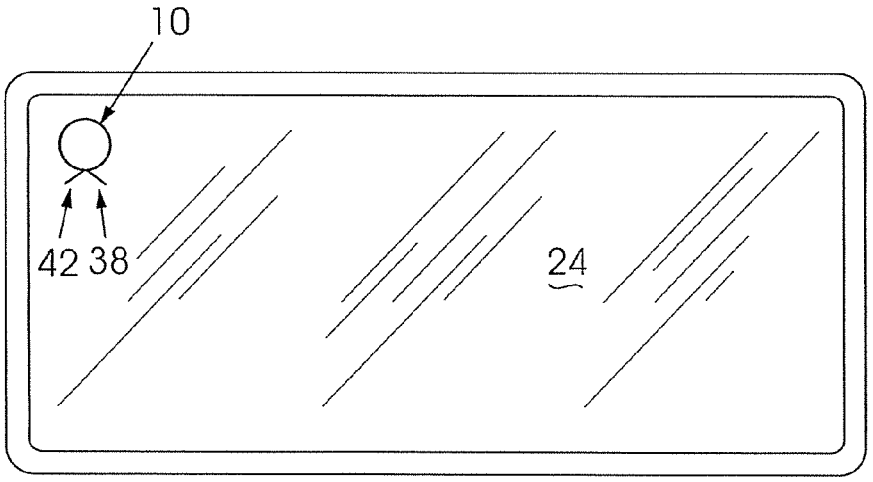
FIG. 7 shows the punch device installed on a rear window of a motor vehicle.

The assembled punch device 10 is installed on a pane or sheet of glass. This may for example be the rear window of a motor vehicle intended to serve as an emergency exit from the vehicle. FIG. 7 shows the punch device installed on the glass sheet 60 which provides the rear window/emergency exit of a motor vehicle such as a bus.

The device 10 is installed on the glass sheet by peeling off the remaining peel-off layer 31 of the element 30, and then pressing the device onto the surface of the glass sheet such that the adhesive carried by the element adheres it to the glass sheet. This is shown in FIG. 3.

Prior to actuation, as shown in FIG. 3, the sharp tip 22 of the penetrating tool is spaced a small distance from the surface of the glass sheet. The safety device 32, which is interposed on edge between the surface 24 of the actuating disc and the surface of the glass, prevents movement of the actuating disc towards the glass sheet. 60.

The presence of the safety device facilitates installation of the punch device on the glass sheet as it is quite stiff in an axial direction and so allows the device to be pressed against the glass in order to adhere it properly in position without the hard tip 22 penetrating the glass.

If it is ever necessary to break the rear window in order to create an emergency exit from the vehicle, a person in the vehicle grips the pull tab 38 and pulls it sharply. This causes the strip 34 to break at the zone of weakness 46. Continued traction on the pull tab 38 then removes the device 32 by pulling it out from between the actuating disc and the surface of the glass sheet.

Figure 4:
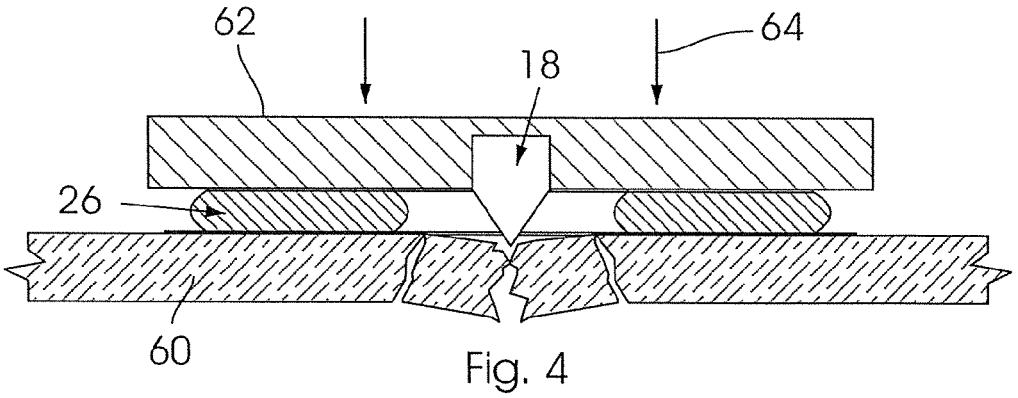
FIG. 4 shows a cross-sectional view of the punch device on actuation.

The person now applies a sharp blow, indicated by the arrows 64 in FIG. 4, to the exposed surface 62 of the actuating disc in a direction towards the glass. This blow could, for example, be applied simply by manually punching the actuating disc.

The removal of the safety device 32 allows the actuating disc 12 to move towards the glass sheet. The force applied to the actuating disc compresses the spacer disc 26 and drives the sharp tip 22 of the penetrating tool into the surface of the glass.

If the force which is applied is of sufficient magnitude, the tip 22 will penetrate through the relatively hard surface skin of the glass and cause the glass sheet to shatter as shown in FIG. 4. The shattering of the glass sheet allows it to be removed entirely to allow persons to escape from the vehicle through the emergency exit which is created. In practice, if the blow which is applied is of insufficient magnitude to shatter the glass further, harder or repetitive blows can be administered until the hard skin of the glass sheet is pierced and shattering of the sheet takes place.

It will be understood that the safety device 32 provides a simple way of preventing inadvertent actuation of the punch device 10. The device 32 is however easily removed, by a sharp pulling action on the tab 38, in an emergency situation in which the device 10 has to be actuated to shatter the glass sheet.

It has been ascertained that the toughened glass sheets used for motor vehicle windows have a hard skin with a depth that is approximately 10% of the overall thickness of the glass sheet, so it is necessary for the hard tip 22 to penetrate the sheet to this depth in order to initiate shattering of the sheet. It has also been ascertained that the hard tip should have a Vickers hardness number of at least 1600 to facilitate the penetration and shattering actions.

It is envisaged that the punch device 10 described above will find application in any situation where it may be necessary to break a sheet of toughened glass in a window, door or otherwise. It is perceived that because of its simplicity, the device will be extremely reliable in operation.

Apart from this the device is very squat and has only a small thickness in a direction transverse to the glass, and therefore presents no real obstacle to persons in close proximity to a window or other glass sheet fitted with the device. In practice, the overall transverse dimension of the device 10, i.e. the axial distance 70 by which the device stands out from the surface of the window/glass sheet before actuation, can be 9 mm or less.

In this embodiment, the actuating disc 10 is made of grade 6082 T6 aluminium with a diameter of about 40 mm.

Numerous modifications may be made within the scope of this invention. For example, where it is considered that the chances of inadvertent actuation of the device 10 are minimal, it would be possible to leave out the safety device 32 altogether. In these cases the spacer disc can be adhered directly to the surface of the glass sheet. In another modification, the penetrating tool and actuating member could be made integral with one another. As indicated previously, the penetrating tool and actuating member could, for example, be made as an integral one-piece ceramic casting or an integral, one-piece tungsten carbide pressing.

The actuating disc could of course have any suitable shape and need not be circular. It should also be understood that the hard tip 22 of the penetrating tool does not have to be spaced from the surface of the glass sheet when the device 10 is initially installed. Even if the tip is in contact with the surface of the glass sheet, the sheet will still be shattered if sufficient force is applied to the actuating disc to drive the tip through the hard skin of the glass sheet.

The invention could also be used in double- or triple-glazed installations. As is well known, double- or triple glazing is used for thermal or sound insulation purposes. In a double-glazed installation, a first punch device as described above is installed at a selected position between the two sheets of glass, and a second, similar punch device is installed on an exposed surface of one of the glass sheets in direct axial alignment with the first device.

In order to shatter both sheets of glass, sufficient force is applied to the second punch device to shatter the sheet on which it is installed, with the applied force, possibly with the application of further impacts, then being transmitted to the first punch device in order to cause shattering of the other glass sheet as well.

In a triple glazed installation respective, aligned punch devices are installed in the gaps between the three sheets of glass with a further, exposed punch device installed on an outer glass sheet, in alignment with the other punch devices. In this case, sufficient force applied to the exposed punch device causes the outer glass sheet to shatter, with force sequentially transmitted to the other punch devices in order to shatter the other glass sheets.

It will be understood that in a double- or triple-glazed installation, the safety device 32 will be absent from the each inner punch device, i.e. the or each punch device which is located between spaced apart sheets of glass, and may be included only in the outer, accessible punch device.

In an application such as that illustrated in FIG. 7 and described above, it would be advantageous to provide a clear plastic film, for example of acrylic or vinyl, which is adhered to the surface of the glass sheet. When the glass sheet is shattered, the glass fragments will adhere to the film. All the adhering fragments can then be removed in a single operation.

In the case of a double- or triple-glazed installation as described above, it would be possible to adhere the outer punch device to a film or membrane applied to the outer glass sheet. This serves to hold the punch device in position, in axial alignment with the or each inner punch device, after the outer glass sheet is shattered and thereby ensures that the applied force is properly transmitted to the inner punch device(s).

In a double-glazed emergency window in a bus, the clear space between the two glass sheets is typically about 10 mm. A preferred overall thickness of 9 mm or less for the punch device enables it to be installed between the glass sheets with minimal clearance.

FIG. 7 shows a punch device 10 according to the invention installed near to an upper corner of the glass sheet.

This is preferred in a double-glazed installation that is subject to vibration, for example a double-glazed emergency window in a bus or other vehicle. The reason is that vibrations of the glass sheets, caused for example by movement of the vehicle, will be reduced towards the sides and corners of the glass compared to in a more central region. This in turn reduces the chances of the outer glass sheet vibrating noisily against the actuating member of the inner punch device. Nevertheless it will be understood that installation could be at any other suitable position, particularly in single-glazed installations.

FIGS. 8 to 13 illustrate punch devices according to a second embodiment of the invention. The second embodiment has many similarities to the first embodiment, and corresponding components are designated by the same reference numerals as are used in the earlier Figures, prefixed by the numeral "1".

Figure 8:
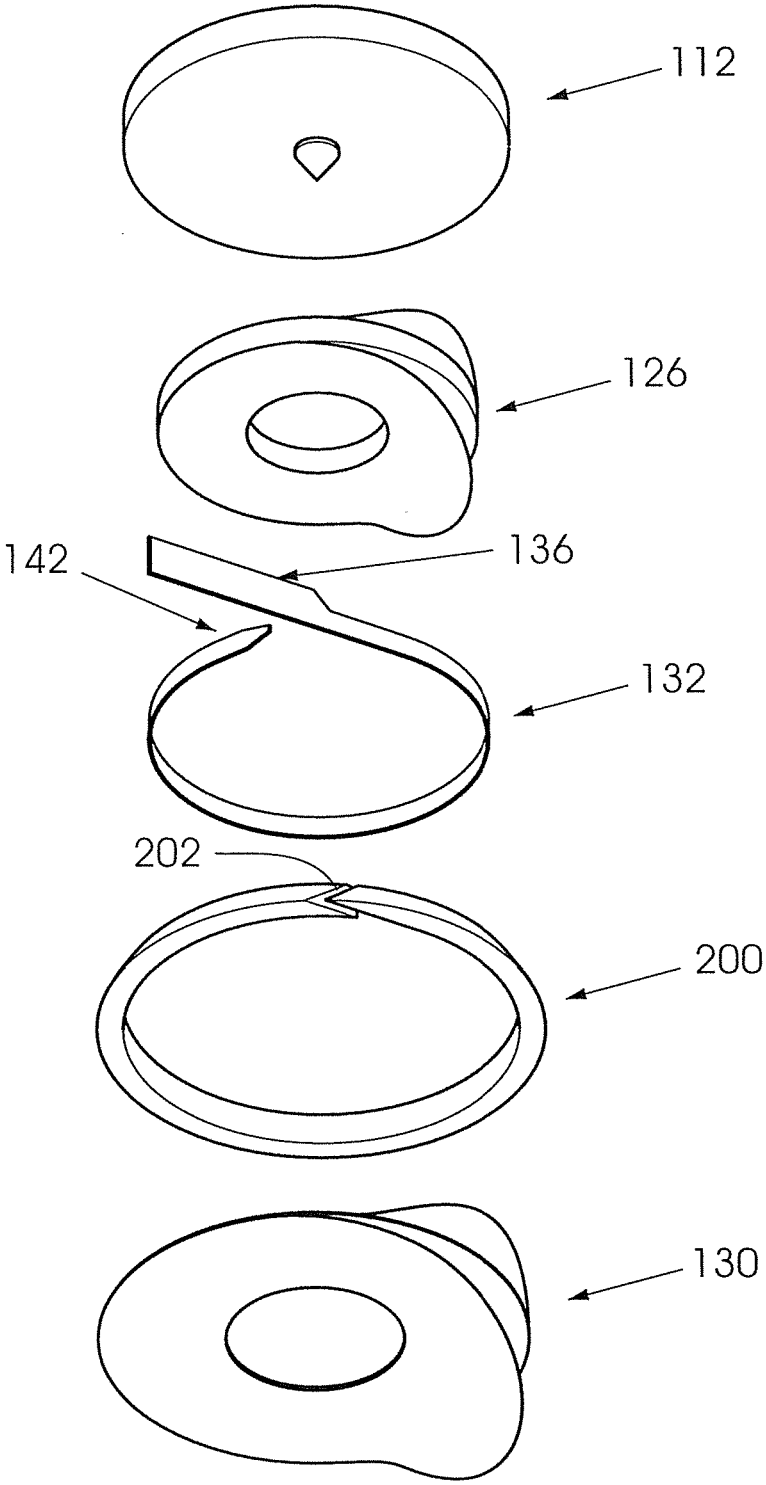
FIG. 8 shows an exploded bottom perspective view of a second embodiment of punch device according to the invention.
Figure 9:
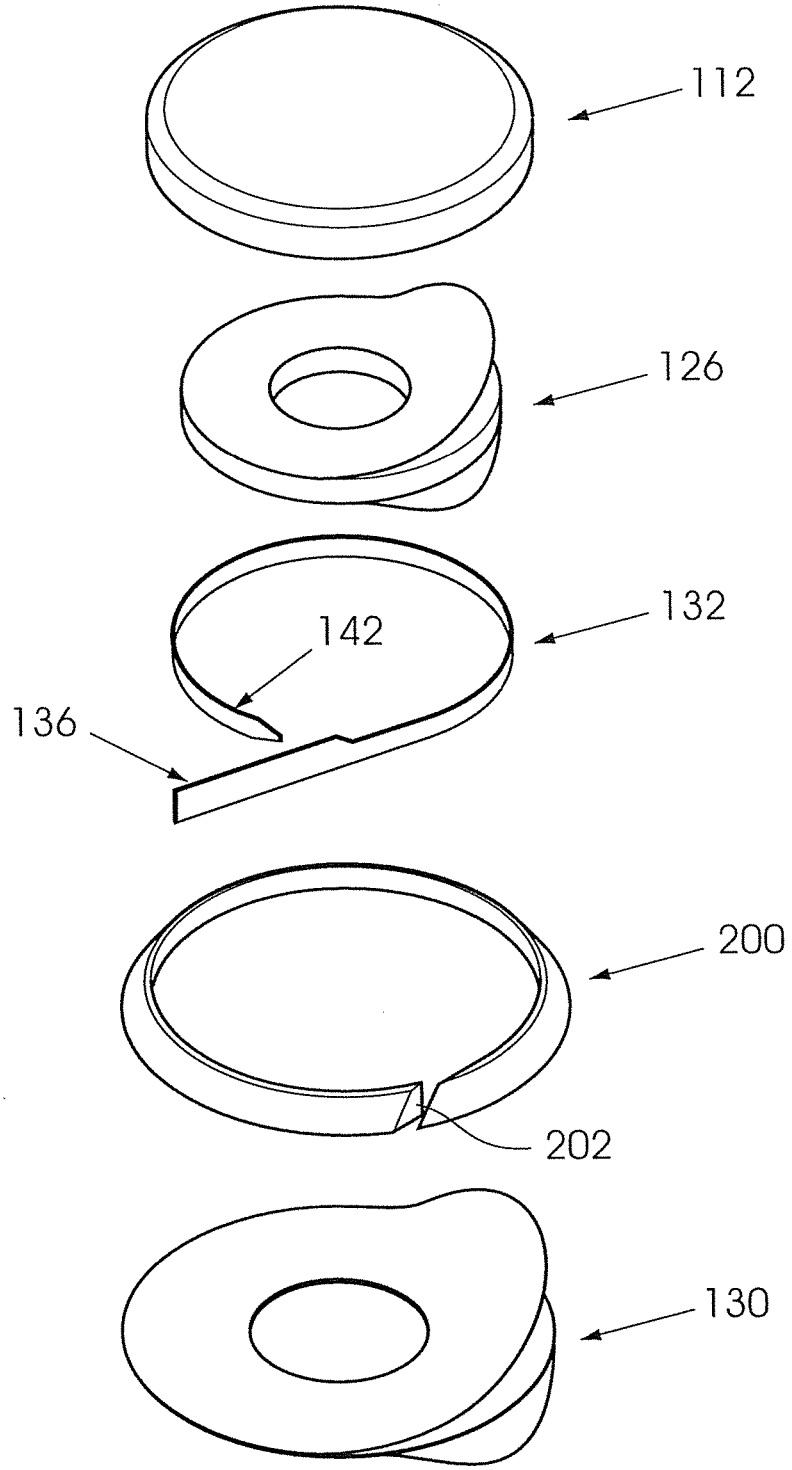
FIG. 9 shows an exploded top perspective view of the second embodiment of opuonch device.
Figure 11:
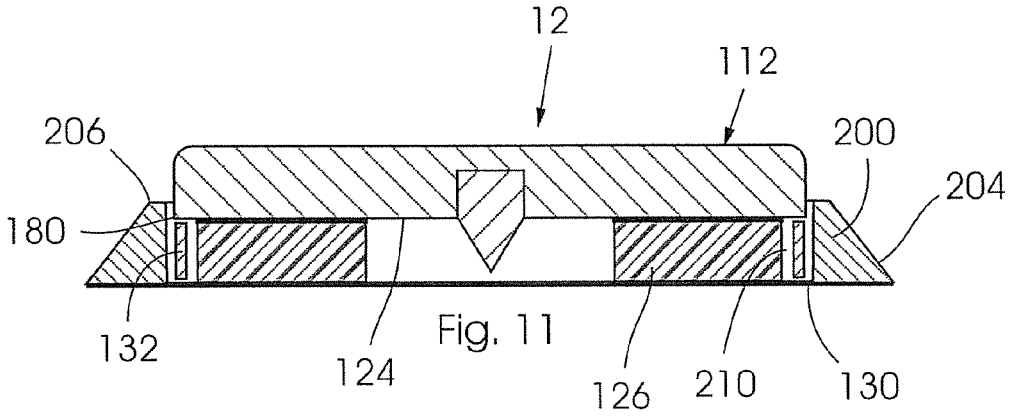
FIG. 11 shows a cross-sectional view of the second embodiment assembled.
Figure 12:
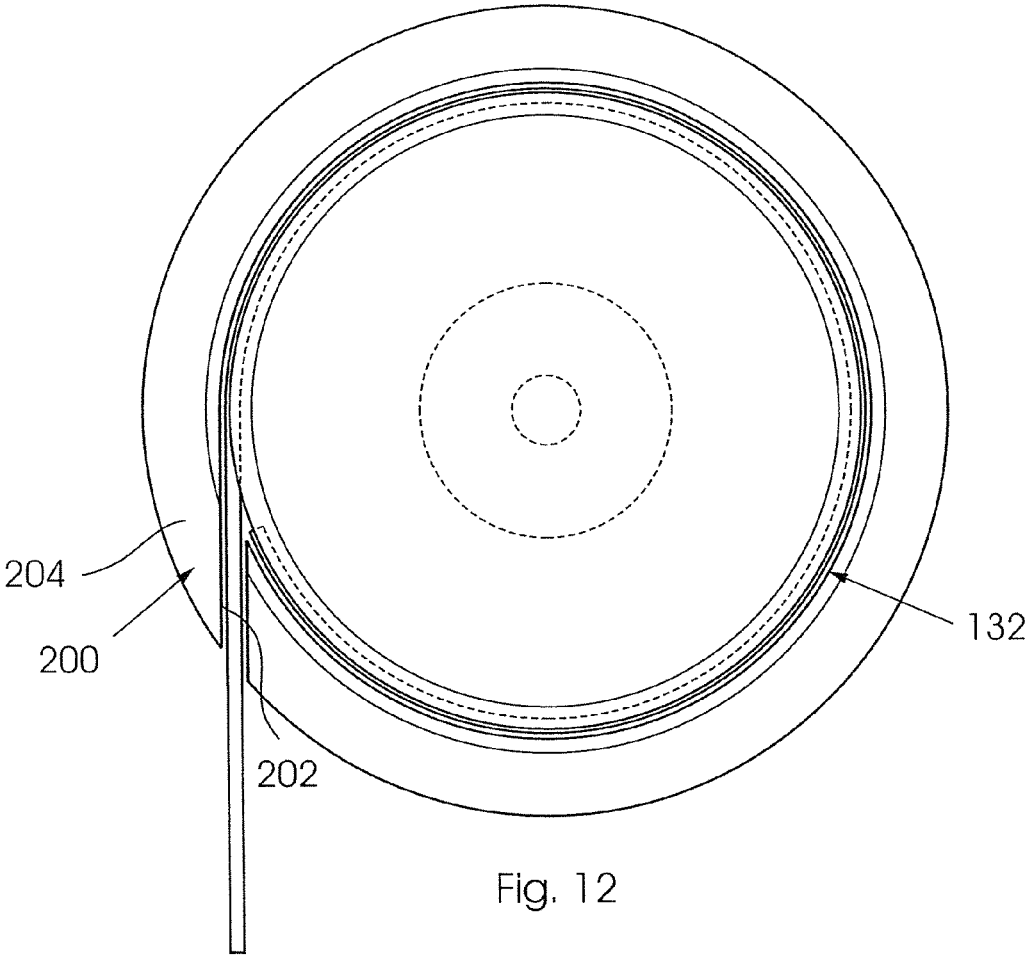
FIG. 12 shows a view, on the arrow 12 in FIG. 11, of the second embodiment.

One difference between the second embodiment and first embodiment is the inclusion of a cover member in the form of an annular cover ring 200. As shown in FIGS. 8, 9 and 12, the cover ring 200 is circular in shape and is circumferentially discontinuous by virtue of a generally tangential slot 202 through it. Referring to FIG. 11, it can be seen that the cover ring has a trapezoidal cross-section with a sloping outer wall surface 204.

The safety device 132 is also different to the corresponding safety device 32 of the first embodiment. In this case, the end 136 of the device has no slot corresponding to the slot 40 of the first embodiment, and the end 142 is pointed but not arrow-shaped.

FIG. 11 shows the second embodiment in an assembled state with the cover ring 200 adhered to the adhesive element 130 and closely surrounding the actuating member 112. The axial thickness of the cover ring 200 is such that its edge 206 covers the edge 180 of the actuating member.

The safety device 132 in this embodiment is located in the form of a loop beneath the surface 124 of the actuating member 112. After assembly of the other components it is installed in this position by feeding or threading it, pointed end 142 first, through the slot 202 and into the radial gap 210 between the spacer 126 and the cover ring 200. The flexibility of the safety device enables it to follow the circular shape of the gap 210 as it is fed through the slot 202. When the device 132 has been fully inserted, the pull tab 138 projects from the slot 202 as seen in FIGS. 10 and 12.

Figure 10:
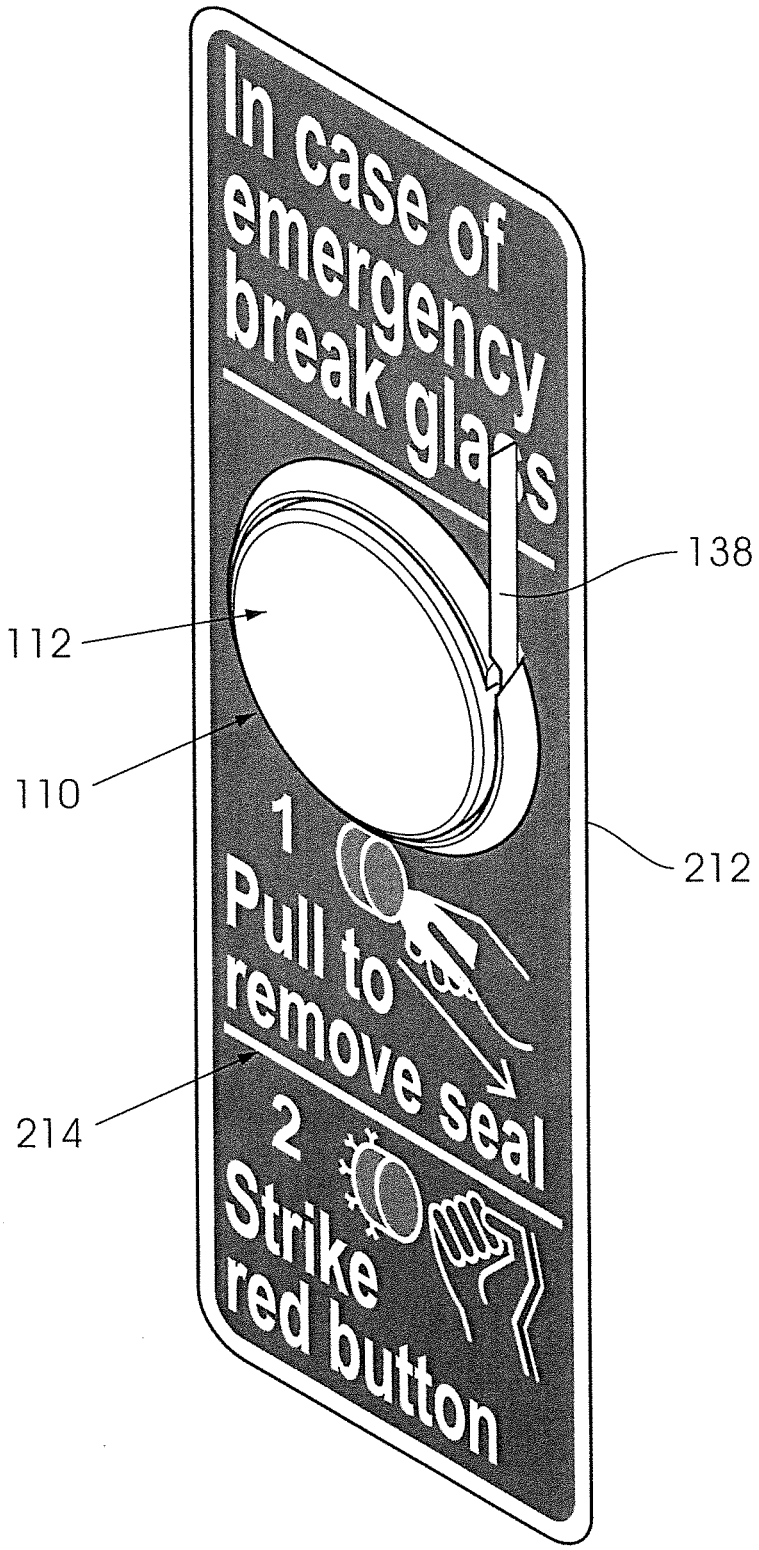
FIG. 10 shows the second embodiment in combination with an information panel.

As shown in FIG. 10, the punch device 110 can be fixed by the adhesive element 130 on a panel 212 which is pre-printed with operating instructions 214. The panel 212 may itself have an adhesive rear surface by means of which it can be stuck at a selected position on a glass sheet, such as an emergency exit window in a bus. Typically, the positioning of the punch device 110 is such that the pull tab projects upwardly as shown.

In an emergency situation where it is required to break the glass sheet, the pull tab 138 is pulled out of the gap 210. In practice, if a person grips the pull tab and pulls it in a direction away from the glass, the safety device will be pulled through the slot and out of the gap 210. After complete removal of the safety device, the operation of the punch device 110 is the same as previously described for the first embodiment, i.e. one or more impacts applied to the actuating device 112 will drive the pointed tip of the penetrating tool into contact with the glass sheet, with corresponding compression of the spacer 126, thereby breaking the glass.

As indicated above, the cover ring 200 covers the edge 180 of the actuating member 110. Referring to FIG. 3, the corresponding edge 80 of the actuating member 12 is exposed. With this configuration it is potentially possible for a vandal to grip the edge of the actuating member, or wedge a tool beneath the edge, in order to prise the punch device off the glass sheet on which it is installed. However, with the cover ring 200 of the second embodiment in position, the edge 180 is inaccessible so potential vandalism of this kind can be avoided.

Figure 13:
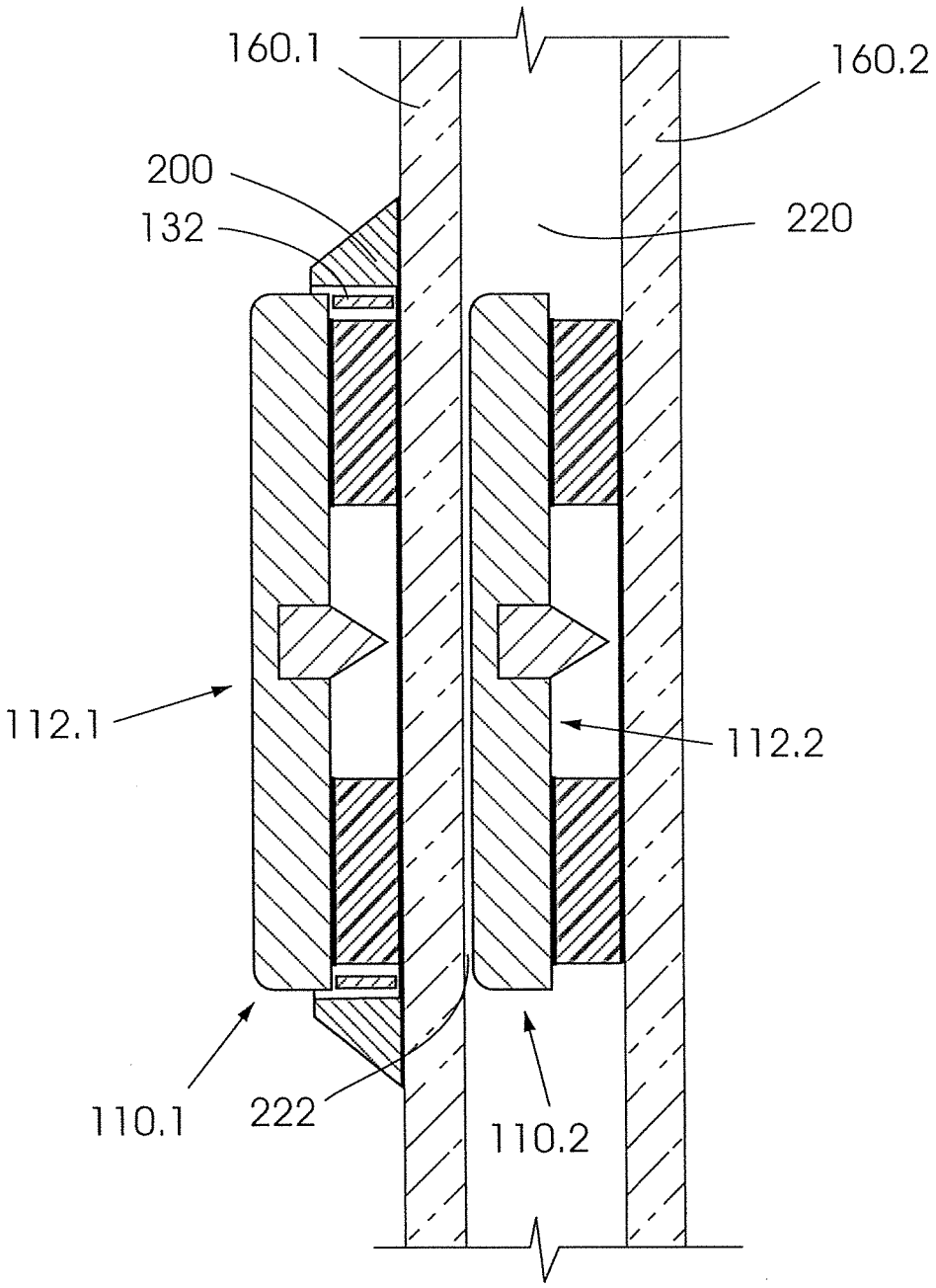
FIG. 13 shows punch devices according to the second embodiment in a double-glaze installation.

FIG. 13 illustrates inner and outer punch devices 110.1, 110.2 in axial alignment with one another in a double-glazed installation, typically a double-glazed emergency exit bus window. Inner and outer sheets of glass are designated by the numerals 160.1 and 160.2 respectively. As illustrated, the inner punch device 110.1 includes the cover ring 200 and the safety device 132, while the outer punch device 110.2, located between the glass sheets, includes neither of these components.

After removal of the safety device 132 from the inner punch device 110.1 in the manner described above, one or more sharp impacts are applied to the actuating member 112.1 to break the inner glass sheet 160.1. The impact carries through to the outer punch device 110.2, causing that device to break the outer glass sheet 160.2.

As explained previously, the width of the gap 220 between the glass sheets of a double-glazed installation is typically 10 mm. The overall thickness of a punch device 110 for such an installation should accordingly be less than 10 mm so that a punch device 110.2 can be installed between the glass sheets as shown in FIG. 13. As in the first embodiment, the preferred overall thickness of the punch devices is 9 mm or less, leaving only a minimal gap 222 of about 1 mm between the outer surface of the inner glass sheet 160.1 and the actuating member 112.2.

The invention claimed is:

1. A punch device comprising an actuating member of flat proportions, a penetrating tool with a sharp tip carried by the actuating member and projecting transversely from a surface of the actuating member, a compressible spacer attached to the surface of the actuating member alongside the penetrating tool and mounting means for mounting the punch device on a glass sheet with the tip of the penetrating tool directed towards the glass sheet, such that a force of sufficient magnitude applied to the actuating member in an axial direction towards the glass sheet compresses the spacer and drives the tip of the penetrating tool into contact with the glass sheet thereby to break the glass sheet.

2. The punch device according to claim 1 wherein the actuating member comprises a flat disc of rigid material.

3. The punch device according to claim 1, wherein the penetrating tool projects from a major surface of the disc.

4. The punch device according to claim 3, wherein the penetrating tool comprises a body of hard material which has a base at one end and a sharp tip at an opposite end, the base of the body being set into the disc with the tip projecting from the disc.

5. The punch device according to claim 4, wherein the disc is made of aluminium and the penetrating tool is made of tungsten carbide.

6. The punch device according to claim 3, wherein the disc and penetrating tool are formed integrally in one piece.

7. The punch device according to claim 6, wherein the disc and penetrating tool are formed as a one-piece ceramic casting or a one-piece tungsten carbide pressing.

8. The punch device according to claim 1, wherein the spacer is an annular disc of compressible foam material surrounding the penetrating tool.

9. The punch device according to claim 8, wherein the disc of foam material is adhered to the surface of the actuating member.

10. The punch device according to claim 1, wherein the mounting means comprises means for adhering the punch device to the glass sheet.

11. The punch device according to claim 1, further comprising a safety device located operatively in use between the actuating member and the glass sheet when the punch device is adhered to the glass sheet in order to prevent movement of the sharp tip of the penetrating tool into contact with the glass, the safety member being removable to allow such movement.

12. The punch device according to claim 11, wherein the safety member comprises a breakable loop located about the compressible spacer.

13. The punch device according to claim 12, wherein the loop comprises an elongate element having a first end acting as a pull tab and a second end which passes through an opening in the element in or near the pull tab, the element having a zone of weakness at which it will break if a pulling force of sufficient magnitude is applied to the pull tab.

14. The punch device according to claim 11, further comprising a cover member extending about a peripheral edge of the actuating member to prevent access to such edge for the purposes of prising the punch device off a glass sheet to which it is adhered.

15. The punch device according to claim 14, wherein the safety device comprises a strip of flexible material threaded into a gap between the cover member and the compressible spacer.

16. The punch device according to claim 1, where an overall thickness of the punch device, measured in the axial direction, is less than 10 mm.

17. The punch device according to claim 16, wherein the overall thickness of the punch device, measured in the axial direction, is 9 mm or less.

18. A multi-glazed installation comprising a first glass sheet, a second glass sheet spaced from the first glass sheet, a first punch device according to claim 1, mounted on the first glass sheet and a second punch device according claim 1 mounted on the second glass sheet in the space between the glass sheets with the penetrating tools of the punch devices being in axial alignment with one another.

19. The installation according to claim 18 wherein an overall thickness of the second punch device, measured in the axial direction, is less than 10 mm.

20. The installation according to claim 19, wherein the overall thickness of the second punch device, measured in the axial direction, is 9 mm or less.

* * * * *